United States Patent [19]

Winter et al.

[11] Patent Number: 4,457,355

[45] **Date of Patent: * Jul. 3, 1984**

[54] APPARATUS AND A METHOD FOR MAKING THIXOTROPIC METAL SLURRIES

[75] Inventors: Joseph Winter, New Haven; Jonathan A. Dantzig, Hamden; Derek E. Tyler, Cheshire, all of Conn.

[73] Assignee: International Telephone and Telegraph Corporation, New York, N.Y.

[ * ] Notice: The portion of the term of this patent subsequent to Mar. 6, 2001 has been disclaimed.

[21] Appl. No.: 545,119

[22] Filed: Oct. 26, 1983

Related U.S. Application Data

[63] Continuation of Ser. No. 184,089, Sep. 4, 1980, abandoned, which is a continuation of Ser. No. 015,059, Feb. 26, 1979, abandoned.

[51] Int. Cl.[3] ..... B22D 27/02

[52] U.S. Cl. ..... 164/468; 164/504; 164/418; 164/459

[58] Field of Search ..... 164/459, 468, 504, 418

[56] References Cited

U.S. PATENT DOCUMENTS

| | | | |
|---|---|---|---|
| 2,672,665 | 3/1954 | Gardner et al. | 164/459 |
| 2,963,758 | 12/1960 | Pestel et al. | 164/468 X |
| 3,954,455 | 5/1976 | Flemings et al. | 75/134 R |
| 4,229,210 | 10/1980 | Winter et al. | 75/10 R |

*Primary Examiner*—Kuang Y. Lin

*Attorney, Agent, or Firm*—James B. Raden; Harold J. Holt

[57] ABSTRACT

An apparatus and a method for forming a semi-solid thixotropic slurry. The apparatus includes a duplex mold arrangement for postponing solidification within the mold until the molten metal is within a magnetic field for providing magnetohydrodynamic stirring. The duplex mold includes a first portion of low thermal conductivity and a second portion of high conductivity.

11 Claims, 6 Drawing Figures

APPARATUS AND A METHOD FOR MAKING THIXOTROPIC METAL SLURRIES

This application is a continuation, of application Ser. No. 184,089, filed Sept. 4, 1980, now abandoned, which in turn is a continuation of application Ser. No. 015,059, filed Feb. 26, 1979 and now abandoned.

BACKGROUND OF THE INVENTION

This invention relates to an apparatus and a method for forming semi-solid thixotropic alloy slurries for use in applications such as rheocasting, thixocasting, or thixoforging.

PRIOR ART STATEMENT

The known methods for producing semi-solid thixotropic alloy slurries include mechanical stirring and inductive electromagnetic stirring. The processes for producing such a slurry with a proper structure require a balance between the shear rate imposed by the stirring and the solidification rate of the material being cast.

The mechanical stirring approach is best exemplified by reference to U.S. Pat. Nos. 3,902,544, 3,954,455, 3,948,650, all to Flemings et al. and 3,936,298 to Mehrabian et al. The mechanical stirring approach is also described in articles appearing in *AFS International Cast Metals Journal,* Sept., 1976, pages 11–22, by Flemings et al. and *AFS Cast Metals Research Journal,* Dec., 1973, pages 167–171, by Fascetta et al. In German OLS No. 2,707,774 published Sept. 1, 1977 to Feurer et al. the mechanical stirring approach is shown in a somewhat different arrangement.

In the mechanical stirring process, the molten metal flows downwardly into an annular space in a cooling and mixing chamber. Here the metal is partially solidified while it is agitated by the rotation of a central mixing rotor to form the desired thixotropic metal slurry for rheocasting. The mechanical stirring approaches suffer from several inherent problems. The annulus formed between the rotor and the mixing chamber walls provides a low volumetric flow rate of thixotropic slurry. There are material problems due to the erosion of the rotor. It is difficult to couple mechanical agitation to a continuous casting system.

In the continuous rheocasting processes described in the art the mixing chamber is arranged above a direct chill casting mold. The transfer of the metal from the mixing chamber to the mold can result in oxide entrainment. This is a particularly acute problem when dealing with reactive alloys such as aluminum, which are susceptible to oxidation. The volumetric flow rates achievable by this approach are inadequate for commercial application.

The slurry is thixotropic, thus requiring high shear rates to effect flow into the continuous casting mold. Using the mechanical approach, one is likely to get flow lines due to interrupted flow and/or discontinuous solidification. The mechanical approach is also limited to producing semi-solid slurries, containing from about 30 to 60% solids. Lower fractions of solids improve fluidity but enhance undesired coarsening and dendritic growth during completion of solidification. It is not possible to get significantly higher fractions of solids because the agitator is immersed in the slurry.

In order to overcome the aforenoted problems inductive electromagnetic stirring has been proposed in U.S. application Ser. No. 859,132, filed Dec. 12, 1977 by Winter et al. for an "Improved Method for the Preparation of Thixotropic Slurries". In that application two electromagnetic stirring techniques are suggested to overcome the limitations of mechanical stirring. Winter et al. use either AC induction or pulsed DC magnetic fields to produce indirect stirring of the solidifying alloy melt. While the indirect nature of this electromagnetic stirring is an improvement over the mechanical process, there are still limitations imposed by the nature of the stirring technique.

With AC inductive stirring, the maximum electromagnetic forces and associated shear are limited to the penetration depth of the induced currents. Accordingly, the section size that can be effectively stirred is limited due to the decay of the induced forces from the periphery to the interior of the melt. This is particularly aggravated when a solidifying shell is present. The inductive electromagnetic stirring process also requires high power consumption and the resistance heating of the stirred metal is significant. The resistance heating in turn increases the required amount of heat extraction for solidification.

The pulsed DC magnetic field technique is also effective, however, it is not as effective as desired because the force field rapidly diverges as the distance from the DC electrode increases. Accordingly, a complex geometry is required to produce the required high shear rates and fluid flow patterns to insure production of slurry with a proper structure. Large magnetic fields are required for this process and, therefore, the equipment is costly and very bulky.

The abovenoted Flemings et al. patents make brief mention of the use of electromagnetic stirring as one of many alternative stirring techniques which could be used to produce thixotropic slurries. They fail, however, to suggest any indication of how to actually carry out such an electromagnetic stirring approach to produce such a slurry. The German patent publication to Feurer et al. suggests that it is also possible to arrange induction coils on the periphery of the mixing chamber to produce an electromagnetic field so as to agitate the melt with the aid of the field. However, Feurer et al. does not make it clear whether or not the electromagnetic agitation is intended to be in addition to the mechanical agitation or to be a substitute therefore. In any event, it is clear that Feurer et al. is suggesting merely an inductive type electromagnetic stirring approach.

There is a wide body of prior art dealing with electromagnetic stirring techniques applied during the casting of molten metals and alloys. U.S. Pat. Nos. 3,268,963 to Mann; 3,995,678 to Zavaras et al.; 4,030,534 to Ito et al.; 4,040,467 to Alherny et al.; 4,042,007 to Zavaras et al.; and 4,042,008 to Alherny et al., as well as an article by Szekely et al. entitled *Electromagnetically Driven Flows in Metals Processing,* Sept. 1976, Journal of Metals, are illustrative of the art with respect to casting metals using inductive electromagnetic stirring provided by surrounding induction coils.

In order to overcome the disadvantages of inductive electromagnetic stirring it has been found in accordance with the present invention that electromagnetic stirring can be made more effective, with a substantially increased productivity and with a less complex application to continuous type casting techniques, if a magnetic field which moves transversely of the mold or casting axis such as a rotating field is utilized.

The use of rotating magnetic fields for stirring molten metals during casting is known as exemplified in U.S.

Pat. Nos. 2,963,758 to Pestel et al. and 2,861,302 to Mann et al. and in U.K. Pat. Nos. 1,525,036 and 1,525,545. Pestal et al. disclose both static casting and continuous casting wherein the molten metal is electromagnetically stirred by means of a rotating field. One or more multipoled motor stators are arranged about the mold or solidifying casting in order to stir the molten metal to provide a fine grained metal casting. In the continuous casting embodiment disclosed in the patent to Pestal et al. a 6 pole stator is arranged about the mold and two two pole stators are arranged sequentially thereafter about the solidifying casting.

Hot-tops are known for use in direct chill casting as exemplified by U.S. Pat. Nos. 3,477,494 to Burkart et al.; 3,612,151 to Harrington et al.; and 4,071,072 to McCubbin.

SUMMARY OF THE INVENTION

The disadvantages associated with the prior art approaches for making thixotropic slurries utilizing either mechanical agitation or inductive electromagnetic stirring have been overcome in accordance with the invention disclosed in our companion U.S. application Ser. No. 469,486, filed on the 24th of February 1983, now U.S. Pat. No. 4,434,837, issued on Mar. 6, 1984. In our companion application magnetohydromagnetic motion associated with a rotating magnetic field generated by a two pole multiphase motor stator is used to achieve the required high shear rates for producing thixotropic semi-solid alloy slurries. The magnetohydromagnetic process therein disclosed provides high volumetric flow rates which make the process particularly adaptable to continuous or semi-continuous rheocasting.

The present invention is concerned with the design of the rheocasting mold which is used in the process and apparatus of our companion application. In constructing a suitable casting system for use in rheocasting it is difficult to associate the various elements which make up the system in such a way that the stirring force field generated by the two pole induction motor stator extends over the entire solidification zone. It is preferred to have the manifold which applies the coolant to the mold wall arranged above the stator. This can result in a portion of the mold cavity which extends out of the region wherein an effective magnetic stirring force is provided. That in turn can cause undesired structural variations in the rheocasting which is formed.

To overcome this problem in accordance with the present invention a means is provided for postponing solidification within the mold cavity until the molten metal is within the effective magnetic field which provides the desired magnetohydrodynamic stirring force. This is accomplished in accordance with one embodiment of the invention by providing the upper region of the mold cavity with a low thermal conductivity. Preferably, a partial insulating mold liner is inserted in the upper portion of the mold. The mold liner extends down into the mold cavity for a distance sufficient so that the magnetic stirring force field is intercepted at least in part by the partial mold liner.

The use of a duplex mold in accordance with this invention having an upper portion of low thermal conductivity and a lower portion of higher thermal conductivity insures that the molten metal can solidify under the influence of the rotating magnetic field. This helps the resultant rheocast casting to have a degenerate dendritic structure throughout its cross section even up to its outer surface.

Accordingly, it is an object of this invention to provide a rheocasting mold apparatus which is capable of forming a casting having a rheocast structure throughout its entire cross section.

It is a further object of this invention to provide an apparatus as above wherein the mold cavity includes regions of differing thermal conductivity for preventing premature solidification.

These and other objects will become more apparent from the following description and drawings.

DETAILED DESCRIPTION OF THE PREFERRED EMBODIMENTS

In the background of this application there have been described a number of techniques for forming semi-solid thixotropic metal slurries for use in rheocasting, thixocasting, thixoforging, etc. Rheocasting as the term is used herein refers to the formation of a semi-solid thixotropic metal slurry, directly into a desired structure, such as a billet for later processing, or a die casting formed from the slurry. Thixocasting or thixoforging respectively as the terms are used herein refer to processing which begins with a rheocast material which is then reheated for further processing such as die casting or forging.

This invention is principally intended to provide rheocast material for immediate processing or for later use in various application of such material, such as thixocasting and thixoforging. The advantages of rheocasting, etc., have been amply described in the prior art. Those advantages include improved casting soundness as compared to conventional die casting. This results because the metal is partially solid as it enters the mold and, hence, less shrinkage porosity occurs. Machine component life is also improved due to reduced erosion of dies and molds and reduced thermal shock associated with rheocasting.

The metal composition of a thixotropic slurry comprises primary solid discrete particles and a surrounding matrix. The surrounding matrix is solid when the metal composition is fully solidified and is liquid when the metal composition is a partially solid and partially liquid slurry. The primary solid particles comprise degenerate dendrites or nodules which are generally spheroidal in shape. The primary solid particles are made up of a single phase or a plurality of phases having an average composition different from the average composition of the surrounding matrix in the fully solidified alloy. The matrix itself can comprise one or more phases upon further solidification.

Conventionally solidified alloys have branched dendrites which develop interconnected networks as the temperature is reduced and the weight fraction of solid increases. In contrast thixotropic metal slurries consist of discrete primary degenerate dendrite particles separated from each other by a liquid metal matrix, potentially even up to solid fractions of 80 weight percent. The primary solid particles are degenerate dendrites in that they are characterized by smoother surfaces and a less branched structure which approaches a spheroidal configuration. The surrounding solid matrix is formed during solidification of the liquid matrix subsequent to the formation of the primary solids and contains one or more phases of the type which would be obtained during solidification of the liquid alloy in a more conventional process. The surrounding solid matrix comprises dendrites, single or multiphased compounds, solid solution, or mixtures of dendrites, and/or compounds, and/or solid solutions.

Figure 1:
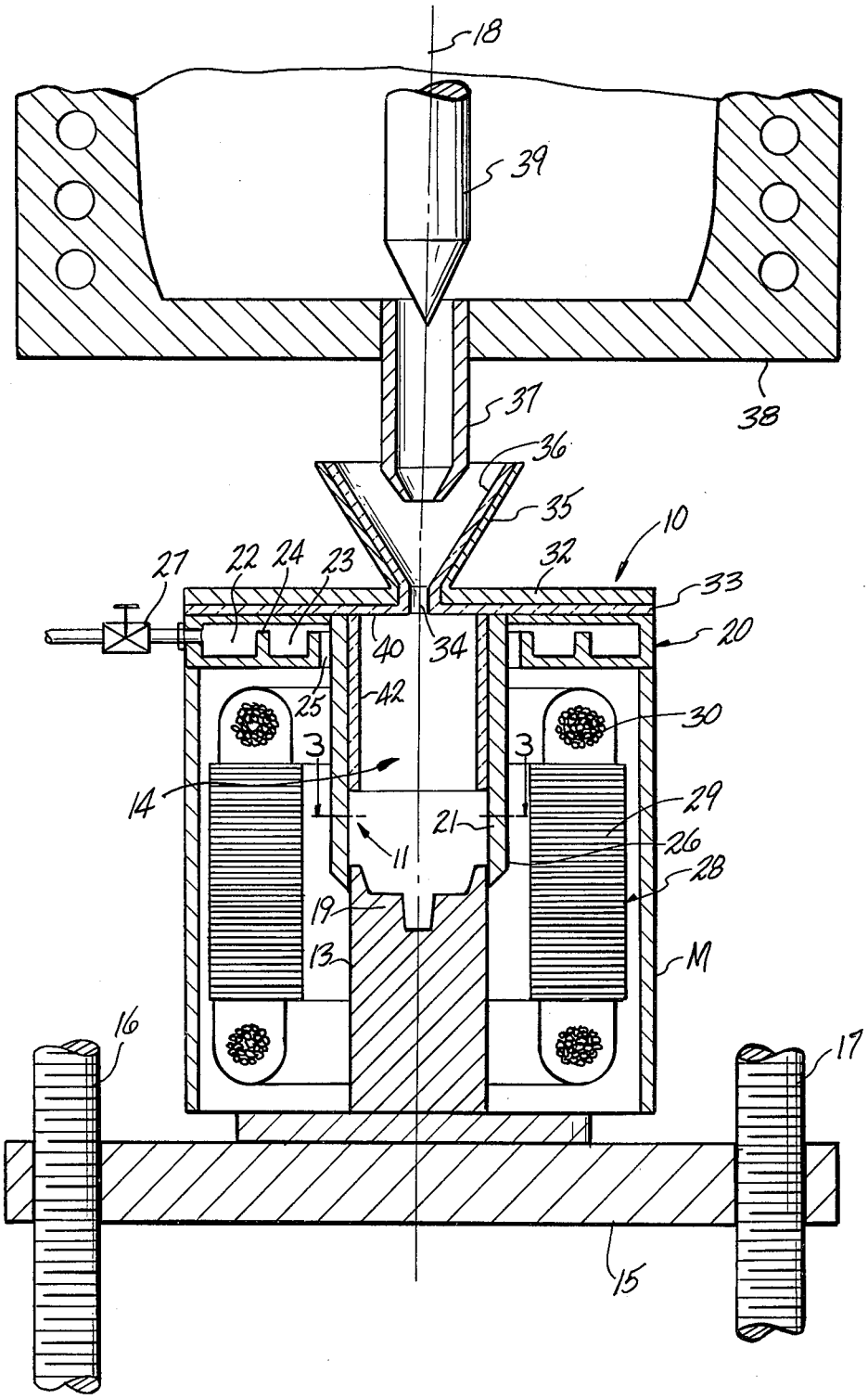
FIG. 1 is a schematic representation in partial cross section of an apparatus in accordance with this invention for continuously or semi-continuously casting a thixotropic semi-solid metal slurry.
Figure 2:
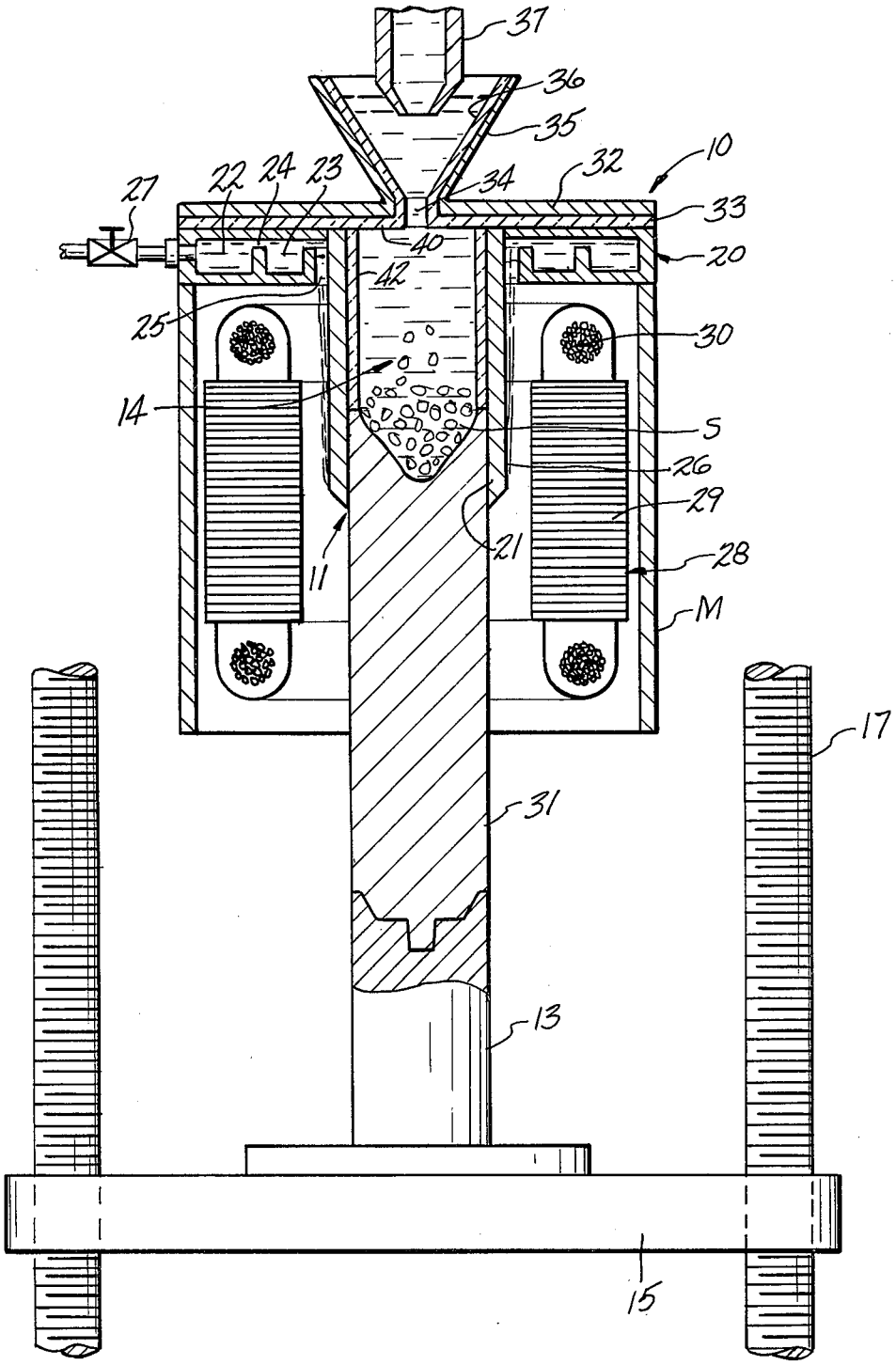
FIG. 2 is a schematic representation in partial cross section of the apparatus of FIG. 1 during a casting operation.

Referring to FIGS. 1 and 2 an apparatus 10 for continuously or semi-continuously rheocasting thixotropic metal slurries is shown. The cylindrical mold 11 is adapted for such continuous or semi-continuous rheocasting. The mold 11 may be formed of any desired nonmagnetic material such as stainless steel, copper, copper alloy or the like.

Figure 3:
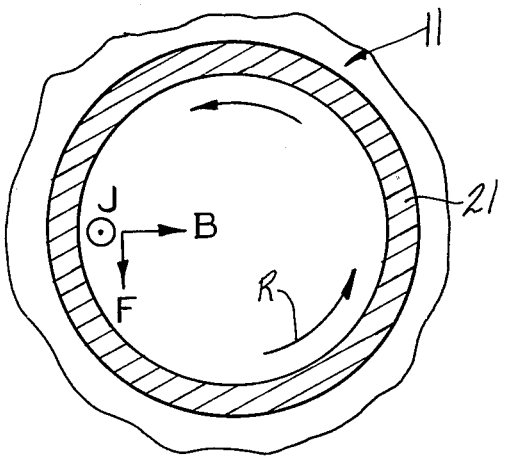
FIG. 3 is a partial cross-sectional view along the line 3—3 in FIG. 1.
Figure 4:
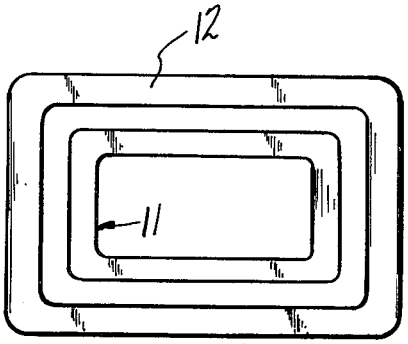
FIG. 4 is a schematic bottom view of a non-circular mold and linear induction motor stator arrangement in accordance with another embodiment of this invention.

Referring to FIG. 3 it can be seen that the mold wall 13 is cylindrical in nature. The apparatus 10 and process of this invention is particularly adapted for making cylindrical ingots utilizing a conventional two pole polyphase induction motor stator for stirring. However, it is not limited to the formation of a cylindrical ingot cross section since it is possible to achieve a transversely or circumferentially moving magnetic field with a non-cylindrical mold 11 as in FIG. 4. In the embodiment of FIG. 4 the mold 11 has a rectangular cross section surrounded by a polyphase rectangular induction motor stator 12. The magnetic field moves or rotates around the mold 11 in a direction normal to the longitudinal axis of the casting which is being made. At this time, the preferred embodiment of the invention is in reference to the use of a cylindrical mold 11.

The bottom block 13 of the mold 11 is arranged for movement away from the mold as the casting forms a solidifying shell. The movable bottom block 13 comprises a standard direct chill casting type bottom block. It is formed of metal and is arranged for movement between the position shown in FIG. 1 wherein it sits up within the confines of the mold cavity 14 and a position away from the mold 11 as shown in FIG. 2. This movement is achieved by supporting the bottom block 13 on a suitable carriage 15. Lead screws 16 and 17 or hydraulic means are used to raise and lower the bottom block 13 at a desired casting rate in accordance with conventional practice. The bottom block 13 is arranged to move axially along the mold axis 18. It includes a cavity 19 into which the molten metal is initially poured and which provides a stabilizing influence on the resulting casting as it is withdrawn from the mold 11.

A cooling manifold 20 is arranged circumferentially around the mold wall 21. The particular manifold shown includes a first input chamber 22, a second chamber 23 connected to the first input chamber by a narrow slot 24. A discharge slot 25 is defined by the gap between the manifold 20 and the mold 11. A uniform curtain of water is provided about the outer surface 26 of the mold 11. A suitable valving arrangement 27 is provided to control the flow rate of the water or other coolant discharged in order to control the rate at which the slurry S solidifies. In the apparatus 10 a manually operated valve 27 is shown, however, if desired this could be an electrically operated valve.

The molten metal which is poured into the mold 11 is cooled under controlled conditions by means of the water sprayed upon the outer surface 26 of the mold 11 from the encompassing manifold 20. By controlling the rate of water flow against the mold surface 26 the rate of heat extraction from the molten metal within the mold 11 is controlled.

In order to provide a means for stirring the molten metal within the mold 11 to form the desired thixotropic slurry a two pole multiphase induction motor stator 28 is arranged surrounding the mold 11. The stator 28 is comprised of iron laminations 29 about which the desired windings 30 are arranged in a conventional manner to provide a three-phase induction motor stator. The motor stator 28 is mounted within a motor housing M. The manifold 20 and the motor stator 28 are arranged concentrically about the axis 18 of the mold 11 and casting 31 formed within it.

It is preferred in accordance with this invention to utilize a two pole three-phase induction motor stator 28. One advantage of the two pole motor stator 28 is that there is a non-zero field across the entire cross section of the mold 11. It is, therefore, possible with this invention to solidify a casting having the desired rheocast structure over its full cross section.

Figure 5:
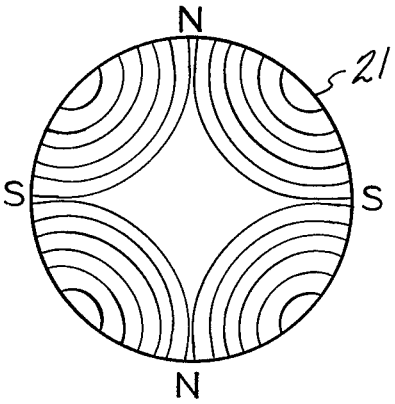
FIG. 5 is a schematic representation of the lines of force at a given instant generated by a four pole induction motor stator.
Figure 6:
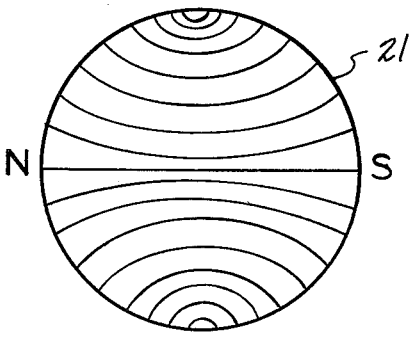
FIG. 6 is a schematic representation of the lines of force at a given instant generated by a two pole motor stator.

FIG. 5 shows the instantaneous lines of force for a four pole induction motor stator at a given instant in time. It is apparent that the center of the mold does not have a desired magnetic field associated with it. Therefore, the stirring action is concentrated near the wall 21 of the mold 11. In comparison thereto, a two pole induction motor stator as shown in FIG. 6 generates instantaneous lines of force at a given instant which provide a non-zero field across the entire cross section of the mold 11. The two pole induction motor stator 28 also provides a higher frequency of rotation or rate of stirring of the slurry S for a given current frequency than the four pole approach of FIG. 5.

A partially enclosing cover 32 is utilized to prevent spill out of the molten metal and slurry S due to the stirring action imparted by the magnetic field of the motor stator 28. The cover 32 comprises a metal plate arranged above the manifold 20 and separated therefrom by a suitable ceramic liner 33. The cover 32 includes an opening 34 through which the molten metal flows into the mold cavity 14. Communicating with the opening 34 in the cover is a funnel 35 for directing the molten metal into the opening 34. A ceramic liner 36 is used to protect the metal funnel 35 and the opening 34. As the thixotropic metal slurry S rotates within the mold 11, cavity centrifugal forces cause the metal to try to advance up the mold wall 21. The cover 32 with its ceramic lining 33 prevents the metal slurry S from advancing or spilling out of the mold 11 cavity and causing damage to the apparatus 10. The funnel portion 35 of the cover 32 also serves as a reservoir of molten metal to keep the mold 11 filled in order to avoid the formation of a U-shaped cavity in the end of the casting due to centrifugal forces.

Situated directly above the funnel 35 is a downspout 37 through which the molten metal flows from a suitable furnace 38. A valve member 39 associated in a coaxial arrangement with the downspout 37 is used in accordance with conventional practice to regulate the flow of molten metal into the mold 11.

The furnace 38 may be of any conventional design, it is not essential that the furnace be located directly above the mold 11. In accordance with convention direct chill casting processing the furnace may be located laterally displaced therefrom and be connected to the mold 11 by a series of troughs or launders.

Referring again to FIG. 3, a further advantage of the rotary magnetic field stirring approach in accordance with this invention is illustrated. In accordance with the Flemings right-hand rule for a given current J in a direction normal to the plane of the drawing the magnetic flux vector B extends radially inwardly of the mold 11 and the magnetic stirring force vector F extends generally tangentially of the mold wall 21. This sets up within the mold cavity a rotation of the molten metal in the direction of arrow R which generates the desired shear for producing the thixotropic slurry S. The force vector F is also tangential to the heat extraction direction and is normal to the direction of dendrite growth. This maximizes the shearing of the dendrites as they grow.

It is preferred in accordance with this invention that the stirring force field generated by the stator 28 extend over the full solidification zone of molten metal and thixotropic metal slurry S. Otherwise the structure of the casting will comprise regions within the field of the stator 28 having a rheocast structure and regions outside the stator field tending to have a non-rheocast structure. In the embodiment of FIGS. 1 and 2 the solidification zone preferably comprises the sump of molten metal and slurry S within the mold 11 which extends from the top surface 40 to the solidification front 41 which divides the solidified casting 31 from the slurry S. The solidification zone extends at least from the region of the initial onset of solidification and slurry formation in the mold cavity 14 to the solidification front 41.

Under normal solidification conditions, the periphery of the ingot 31 will exhibit a columnar dendritic grain structure. Such a structure is undesirable and detracts from the overall advantages of the rheocast structure which occupies most of the ingot cross section. In order to eliminate or substantially reduce the thickness of this outer dendritic layer in accordance with this invention the thermal conductivity of the upper region of the mold 11 is reduced by means of a partial mold liner 42 formed from an insulator such as a ceramic. The ceramic mold liner 42 extends from the ceramic liner 33 of the mold cover 32 down into the mold cavity 14 for a distance sufficient so that the magnetic stirring force field of the two pole motor stator 28 is intercepted at least in part by the partial ceramic mold liner 42. The ceramic mold liner 42 is a shell which conforms to the internal shape of the mold 11 and is held to the mold wall 21. The mold 11 comprises a duplex structure including a low heat conductivity upper portion defined by the ceramic liner 42 and a high heat conductivity portion defined by the exposed portion of the mold wall 21.

The liner 42 postpones solidification until the molten metal is in the region of the strong magnetic stirring force. The low heat extraction rate associated with the liner 42 generally prevents solidification in that portion of the mold 11. Generally solidification does not occur except towards the downstream end of the liner 42 or just thereafter. The shearing process resulting from the applied rotating magnetic field will further override the tendency to form a solid shell in the region of the liner 42. This region 42 or zone of low thermal conductivity thereby helps the resultant rheocast casting 31 to have a degenerate dendritic structure throughout its cross section even up to its outer surface.

Below the region of controlled thermal conductivity defined by the liner 42, the normal type of water cooled metal casting mold wall 21 is present. The high heat transfer rates associated with this portion of the mold 11 promote ingot shell formation. However, because of the zone 42 of low heat extraction rate even the peripheral shell of the casting 31 should consist of degenerate dendrites in a surrounding matrix.

It is preferred in order to form the desired rheocast structure at the surface of the casting to effectively shear any initial solidified growth from the mold liner 42. This can be accomplished by insuring that the field associated with the motor stator 28 extends over at least that portion of the liner 42 at which solidification is first initiated.

The dendrites which initially form normal to the periphery of the casting mold 11 are readily sheared off due to the metal flow resulting from the rotating magnetic field of the induction motor stator 28. The dendrites which are sheared off continue to be stirred to form degenerate dendrites until they are trapped by the solidifying interface 41. Degenerate dendrites can also form directly within the slurry because the rotating stirring action of the melt does not permit preferential growth of dendrites. To insure this the stator 28 length should preferably extend over the full length of the solidification zone. In particular the stirring force field associated with the stator 28 should preferably extend over the full length and cross section of the solidification zone with a sufficient magnitude to generate the desired shear rates.

To form a rheocasting 31 utilizing the apparatus 10 of FIGS. 1 and 2 molten metal is poured into the mold cavity 14 while the motor stator 28 is energized by a suitable three-phase AC current of a desired magnitude and frequency. After the molten metal is poured into the mold cavity it is stirred continuously by the rotating magnetic field produced by the motor stator 28. Solidification begins from the mold wall 21. The highest shear rates are generated at the stationary mold wall 21 or at the advancing solidification front 41. By properly controlling the rate of solidification by any desired means as are known in the prior art the desired thixotropic slurry S is formed in the mold cavity 14. As a solidifying shell is formed on the casting 31, the bottom block 13 is withdrawn downwardly at a desired casting rate.

The shear rates which are obtainable with the process and apparatus 10 of this invention are much higher than those reported for the mechanical stirring process and can be achieved over much larger cross-sectional areas. These high shear rates can be extended to the center of the casting cross section even when the solid shell of the solidifying slurry S is already present.

The induction motor stator 28 which provides the stirring force needed to produce the degenerate dendrite rheocast structure can be readily placed either above or below the primary cooling manifold 20 as desired. Preferably, however, in accordance with this invention, the induction motor stator 28 and mold 11 are located below the cooling manifold 20.

The continuous casting apparatus 10 of this invention is particularly advantageous as compared to the processes and apparatuses described in the prior art. In those processes the stirring chamber is located above a continuous casting mold and the thixotropic slurry S is delivered to the mold. This has the disadvantage that the mold is hard to fill and entrainment of oxides is enhanced. In accordance with this invention the stirring chamber comprises continuous casting mold 11 itself. This process does not suffer from the transfer of contamination problems of the prior art continuous casting process.

It is preferred in accordance with the process and apparatus of this invention that the entire casting solidify in the stator 28 field in order to produce castings with proper rheocast structure through their entire cross section. Therefore, the casting apparatus 10 in accordance with this invention should preferably be designed to insure that the entire solidification zone is within the stator 28 field. This may require extra long stators 28 to be provided to handle some types of casting.

In accordance with this invention two competing processes shearing and solidification are controlling. The shearing produced by the electromagnetic process and apparatus of this invention can be made equivalent to or greater than that obtainable by mechanical stirring. The interaction between shear rates and cooling rates causes higher stator currents to be required for continuous type casting then are required for static casting.

It has been found in accordance with this invention that the effects of the experimental variables in the process can be predicted from a consideration of two dimensionless groups, namely $\beta$ and N as follows:

$$\beta = \sqrt{j\omega\sigma\mu_o R^2} \quad (1)$$

$$N = \frac{\sigma R^2 B_{\theta\omega}^2}{\eta_o} \quad (2)$$

where $j=\sqrt{-1}$ $\omega$=angular line frequency $\sigma$=melt electrical conductivity $\mu_o$=magnetic permeability R=melt radius $B_{\theta w}$=magnetic induction at the mold wall $\eta_o$=melt viscosity.

The first group, $\beta$, is a measure of the field geometry effects, while the second group, N, appears as a coupling coefficient between the magnetomotor body forces and the associated velocity field. The computed velocity and shearing fields for a single value of $\beta$ as a function of the parameter N can be determined.

From these determinations it has been found that the shear rate increases sharply toward the outside of the mold where it reaches its maximum. This maximum shear rate increases with increasing N. It has been concluded that the shearing is produced in the melt because the peripheral boundary or mold wall is rigid. Therefore, even when a solidifying shell is present, there should still be shear stresses in the melt and they should be maximal at the liquid solid interface 41. Further because there are always shear stresses at the advancing interface 41 it is possible to make a full section ingot 31 with the appropriate degenerate dendritic rheocast structure.

The stator current and shear rates required to achieve the desired degenerate dendritic thixotropic slurry S are very much higher than those required to achieve fine dendritic grains in accordance with the prior art as set forth in the background of this application. The process and apparatus 10 of this invention offer several unique advantages in contrast to the processes of the prior art. For example, the loss of magnetic field strength due to the presence of solidifying metal is small due to the low frequency which is used. The equipment associated with the apparatus 10 of this invention is relatively easy to fabricate since two pole induction motor stators 28 are well-known in the art. The apparatus 10 of this invention has a relatively low power consumption and because of the relatively low current as compared to the AC induction method there is little resistance heating of the melt being stirred. The rotating magnetic field stirring method of this invention is indirect and, therefore, has insignificant associated erosion problems. Another advantage of the present process and apparatus is the high volumetric flow rates which are obtainable. This is particularly important if one desires to carry out the rheocasting process continuously or semi-continuously. The duplex mold arrangement comprising regions of low and high thermal conductivity produces castings having the desired rheocast structure throughout while allowing flexibility in the arrangement of various components of the casting system.

EXAMPLE I

Ingots 2.5 inches in diameter of alloy 6061 were cast using an apparatus 10 similar to that shown in FIGS. 1 and 2. The bottom block 13 was lowered and the casting was drawn from the mold 11 at speeds of from about 8 to 14 inches per minute. The two pole three-phase induction motor stator 28 current was varied between 5 and 35 amps. It was found that at the low current end of this range, a fine dendritic grain structure was produced but not the characteristic structure of a rheocast thixotropic slurry. At the high current end of the range particularly in and around 15 amps fully non-dendritic structures were generated having a typical rheocast structure comprising generally spheroidal primary solids surrounded by a solid matrix of different composition.

The mold cover 32 by enclosing the mold cavity 14 except for the small centrally located opening 34 serves not only to prevent spillage of molten metal but also to prevent the formation of a U-shaped cavity in the end of the rheocasting. By adding sufficient molten metal to the mold to at least partially fill the funnel 35 it is possible to insure that the mold cavity 14 is completely filled with molten metal and slurry. The cover 32 offsets the centrifugal forces and prevents the formation of the U-shaped cavity on solidification. By completely filling the mold oxide entrainment in the resulting casting is substantially reduced.

While it is preferred in accordance with this invention that the stirring force due to the magnetic field extend over the entire solidification zone it is recognized that the shearing action on the dendrites results from the rotating movement of the melt. This metal stirring movement can cause shearing of dendrites outside the field if the moving molten metal pool extends outside the field.

Dendrites will initially attempt to grow from the sides or wall 21 of the mold 11. The solidifying metal at the bottom of the mold may not be dendritic because of the comparatively low heat extraction rate which promotes the formation of more equiaxed grains.

Suitable stator currents for carrying out the process of this invention will vary depending on the stator which is used. The currents must be sufficiently high to provide the desired magnetic field for generating the desired shear rates.

Suitable shear rates for carrying out the process of this invention comprise from at least about 100 sec.$^{-1}$ to about 1500 sec.$^{-1}$ and preferably from at least about 500 sec.$^{-1}$ to about 1200 sec.$^{-1}$. For aluminum and its alloys a shear rate of from about 700 sec.$^{1}$ to about 1100 sec.$^{1}$ has been found desirable.

The average cooling rates through the solidification temperature range of the molten metal in the mold should be from about 0.1° C. per minute to about 1000° C. per minute and preferably from about 10° C. per minute to about 500° C. per minute. For aluminum and its alloys an average cooling rate of from about 40° C. per minute to about 500° C. per minute has been found to be suitable. The efficiency of the magnetohydrodynamic stirring allows the use of higher cooling rates than with prior art stirring processes. Higher cooling rates yield highly desirable finer grain structures in the resulting rheocasting. Further, for continuous rheocasting higher throughput follows from the use of higher cooling rates.

The parameter $|\beta^2|$ ($\beta$ defined by equation (1)) for carrying out the process of this invention should comprise from about 1 to about 10 and preferably from about 3 to about 7.

The parameter in N (defined by equation (2)) for carrying out the process of this invention should comprise from about 1 to about 1000 and preferably from about 5 to about 200.

The angular line frequency $\omega$ for a casting having a radius of from about 1" to about 10" should be from about 3 to about 3000 hertz and preferably from about 9 to about 2000 hertz.

The magnetic field strength which is a function of the angular line frequency and the melt radius should comprise from about 50 to 1500 gauss and preferably from about 100 to about 600 gauss.

The particular parameters employed can vary from metal system to metal system in order to achieve the desired shear rates for providing the thixotropic slurry. The appropriate parameters for alloy systems other than aluminum can be determined by routine experimentation in accordance with the principles of this invention.

Solidification zone as the term is used in this application refers to the zone of molten metal or slurry in the mold wherein solidification is taking place. Magnetohydrodynamic as the term is used herein refers to the process of stirring molten metal or slurry using a moving or rotating magnetic field. The magnetic stirring force may be more appropriately referred to as a magnetomotive stirring force which is provided by the moving or rotating magnetic field of this invention.

The process and apparatus of this invention is applicable to the full range of materials as set forth in the prior art including but not limited to aluminum and its alloys, copper and its alloys and steel and its alloys.

The patents, patent applications and articles set forth in this specification are intended to be incorporated by reference herein.

It is apparent that there has been provided in accordance with this invention an apparatus for making thixotropic metal slurries which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In an apparatus for continuously or semi-continuously forming a semi-solid thixotropic alloy slurry, said slurry comprising throughout its cross section degenerate dendrite primary solid particles in a surrounding matrix of molten metal, said apparatus comprising:

means for containing molten metal, said containing means having a desired cross section;

means for controllably cooling said molten metal in said containing means; and means for mixing said molten metal for shearing dendrites formed in a solidification zone as said molten metal is cooled for forming said slurry;

said mixing means comprising a single two pole stator for generating a non-zero rotating magnetic field which moves transversely of a longitudinal axis of said containing means across the entirety of said cross section of said containing means and over said entire solidification zone, said moving magnetic field providing a magnetomotive stirring force directed tangentially of said containing means for causing said molten metal and slurry to rotate in said containing means, said magnetic force being of sufficient magnitude to provide said shearing of said dendrites, said magnetomotive force providing a shear rate of at least 500 sec.$^{-1}$;

the improvement wherein, said containing means includes a first portion of low thermal conductivity and a second portion of high thermal conductivity, said portion of low thermal conductivity extending into said magnetic field for postponing solidification within said containing means until said molten metal is within said magnetic field, thereby promoting the formation of a degenerate dendritic structure throughout the slurry.

2. An apparatus as in claim 1 wherein said first portion of said mold comprises a layer of an insulating material and wherein said second portion of said mold is formed of a non-magnetic metal or alloy.

3. An apparatus as in claim 2 wherein said cooling means is arranged about said first portion of mold.

4. An apparatus as in claim 1 wherein said mold comprises a metal wall member for surrounding said molten metal and slurry, said wall member defining a top and bottom thereof and wherein a partial mold liner is provided internally of said mold wall extending from said top of said mold wall to a position intermediate said top and bottom of said mold wall to define said first portion of said mold, said liner leaving a portion of said metal wall member exposed which defines said second portion of said mold.

5. An apparatus as in claim 4 wherein said liner is formed from an insulating material.

6. An apparatus as in claim 5 wherein said magnetic field overlaps said liner.

7. An apparatus as in claim 6 wherein said mold wall has a cylindrical shape.

8. An apparatus as in claim 6 wherein said mold wall has a non-cylindrical shape.

9. An apparatus as in claim 6 wherein said mold comprises a mold for continuously or semi-continuously forming a rheocasting.

10. An apparatus as in claim 9 wherein said cooling means is arranged about said first portion of said mold and said magnetic field generating means is arranged below said cooling means so that said magnetic field at least in part overlaps said liner.

11. In a process for continuously or semi-continuously forming a semi-solid thixotropic alloy slurry, said slurry comprising throughout its cross section degenerate dendrite primary solid particles in a surrounding matrix of molten metal, said process comprising:

providing a means for containing molten metal having a desired cross section;

controllably cooling said molten metal in said containing means; and mixing said contained molten metal for shearing dendrites formed in a solidification zone as said molten metal is cooled for forming said slurry;

said mixing step comprising generating solely with a two pole stator a non-zero rotating magnetic field which moves transversely of a longitudinal axis of said containing means across the entirety of said cross section of said containing means and over said entire solidification zone, said moving magnetic field providing a magnetomotive stirring force directed tangentially of said containing means for causing said molten metal and slurry to rotate in said containing means, said magnetomotive force being of sufficient magnitude to provide said shearing of said dendrites, said magnetomotive force providing a shear rate of at least 500 $sec.^{-1}$;

the improvement wherein a first region of low thermal conductivity and a second region of high thermal conductivity is provided within said containing means, said region of low thermal conductivity postponing solidification during said mixing step until said molten metal is within said magentic field, thereby promoting the formation of a degenerate dendritic structure throughout the slurry.

* * * * *